US006254062B1

(12) United States Patent
Kapinos, Jr.

(10) Patent No.: US 6,254,062 B1
(45) Date of Patent: Jul. 3, 2001

(54) PROCESS FOR INSTALLING CARPET

(75) Inventor: Thomas John Kapinos, Jr., Hamburg, NY (US)

(73) Assignee: Thomas J. Kapinos, Jr., Hamburg, NY (US)

( * ) Notice: Subject to any disclaimer, the term of this patent is extended or adjusted under 35 U.S.C. 154(b) by 0 days.

(21) Appl. No.: 09/347,724

(22) Filed: Jul. 6, 1999

(51) Int. Cl.[7] ..... B25B 25/00
(52) U.S. Cl. ..... 254/200
(58) Field of Search ..... 254/200–212

(56) References Cited

U.S. PATENT DOCUMENTS 3,747,157 * 7/1973 Szymanski ..... 254/200 X
4,712,165 * 12/1987 Cetrome ..... 362/147
4,772,058 * 9/1988 Andersen ..... 254/200 X
5,183,238 * 2/1993 Sorensen ..... 254/200 X
5,330,436 * 7/1994 Heidmueller ..... 604/167
5,386,605 * 2/1995 Murphy ..... 7/138
5,472,170 * 12/1995 Anasson ..... 254/201 X
5,551,111 * 9/1996 Murphy ..... 7/138
5,873,614 * 2/1999 Taylor et al. ..... 254/200 X
5,938,182 * 8/1999 Goodrich et al. ..... 254/200 X
5,984,274 * 11/1999 Medwin ..... 254/200

* cited by examiner

*Primary Examiner*—Donald P. Walsh
*Assistant Examiner*—Emmanuel M. Marcelo

(57) ABSTRACT

A process for installing carpet in which a T-shaped device comprising tubes extending from a central point is disposed on the carpet, in which one the pipe of one carpet stretching tool is disposed within the first two of the opposed tubes, the pipe of another carpet stretching tool is disposed within the second two of the opposed tubes, and then each of the carpet stetching tools is then used to stretch carpet in a direction substantially perpendicular to the direction of the other tool.

1 Claim, 2 Drawing Sheets

PROCESS FOR INSTALLING CARPET

BACKGROUND OF THE INVENTION

Professional carpet installation requires the use of a specialized installation unit called a powerstretcher. This requirement is cited by the the Carpet and Rug Institute's Standard for residential carpet installation, publication CRI 105. The requirement is also sited in CRI 104, the standard for commercial carpet installation. The said powerstretcher is currently manufactured by several companies. Powerstretching is time consuming and yet, necessary. The Kapinos Adapter is a metal premolded attachment to speed professional installation and ease the rigors of powerstretching carpet. The Kapinos adapter has shown in field tests to cut installation times up to 50%. The Kapinos adapter allows two installers with powerstretchers to stretch both the length and width of a room simultaneously. Powerstretching both the length and the width is a key to professional carpet installation, citing the Carpet and Rug Institute's publications 104 and 105. Currently, a carpet installer can powerstretch in only one direction at a time. The only alternative to this time consuming process is to breach the professional installation guidelines set forth in the cited publications CRI 104 and 105 by knee kicking in one direction while powerstretching in the other. The knee kicking method of stretching is unprofessional and unacceptable. The Kapinos adapter allows two powerstretcher units to intersect while still offering a solid anchorpoint for both units. In particular, the Kapinos adapter intersects the part of the powerstretcher known as the tubes. The tubes are metal, interlocking, telescopic, cylindrical lengths that span across the length or width of a room. This allows for an anchorpoint at the butt end of the tubes and a stretching side on the spiked head, carpet engaging end of the powerstretcher. The Kapinos adapter remains movable along the length of the tubes and the powerstretcher tubes are still fully adjustable. This allows the carpet installers to work efficiently.

BRIEF SUMMARY OF THE INVENTION

The Kapinos Adapter is an attachment to be used in conjunction with existing equipment made for professional carpet installation. In particular, equipment known as powerstretchers. The Kapinos adapter introduces a new method of powerstretching carpet by enabling carpet installers to operate two powerstretching units, stretching both the length and width of a room at the same time. This method of stretching is not an option at this time. The Kapinos adapter will allow for quicker carpet installations while maintaining professional quality.

DETAILED DESCRIPTION OF THE INVENTION

Figure 1:
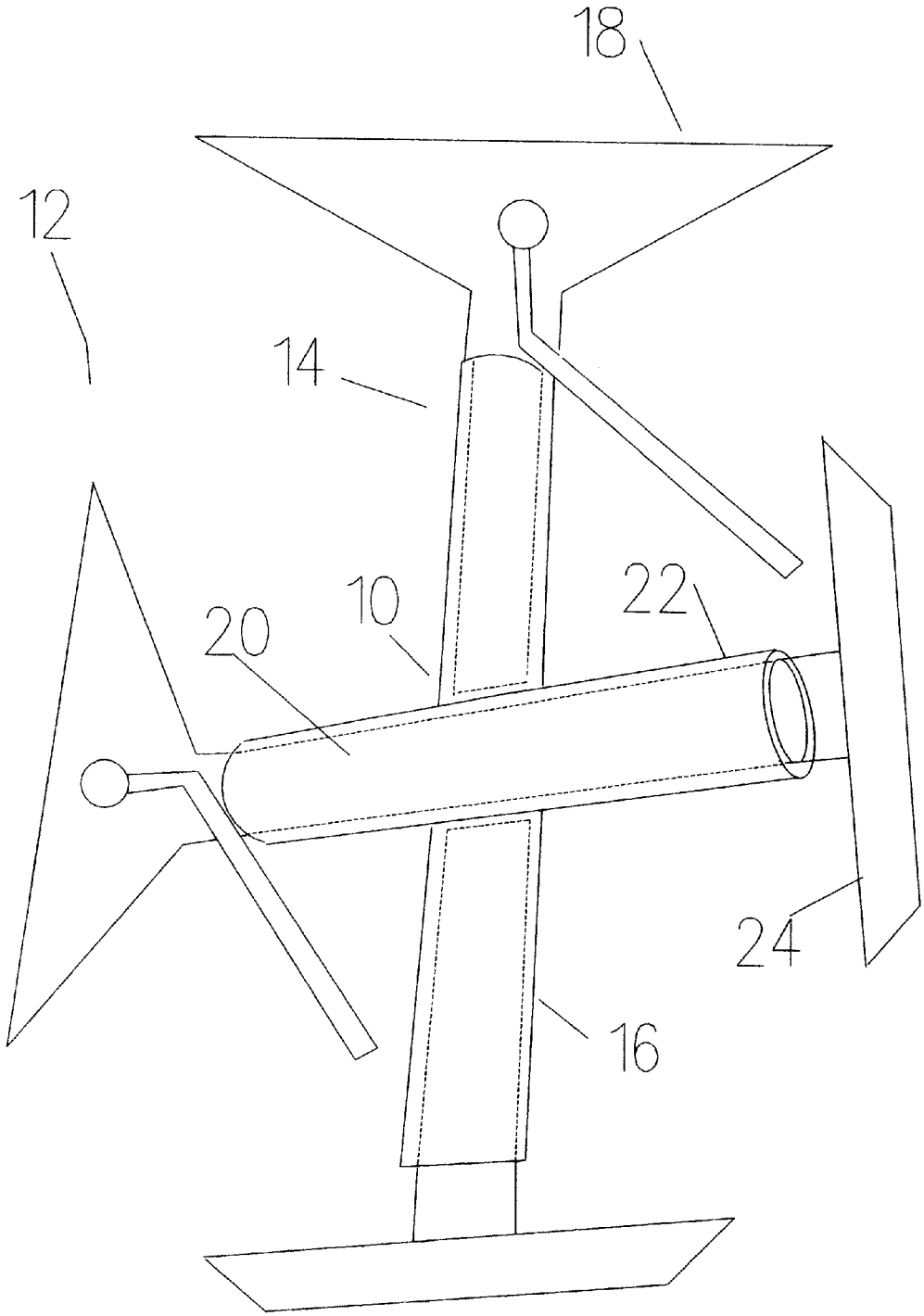
FIG. 1 is a schematic representation of one preferred process of the invention, illustrating an adapter 10 disposed on a carpet 12, pipes 14 and 16 of a first carpet stretching device 18 disposed within one portion of the adapter 10, and pipes 20 and 22 of a second carpet stretching device 24 disposed within another portion of the adapter 10.
Figure 2:
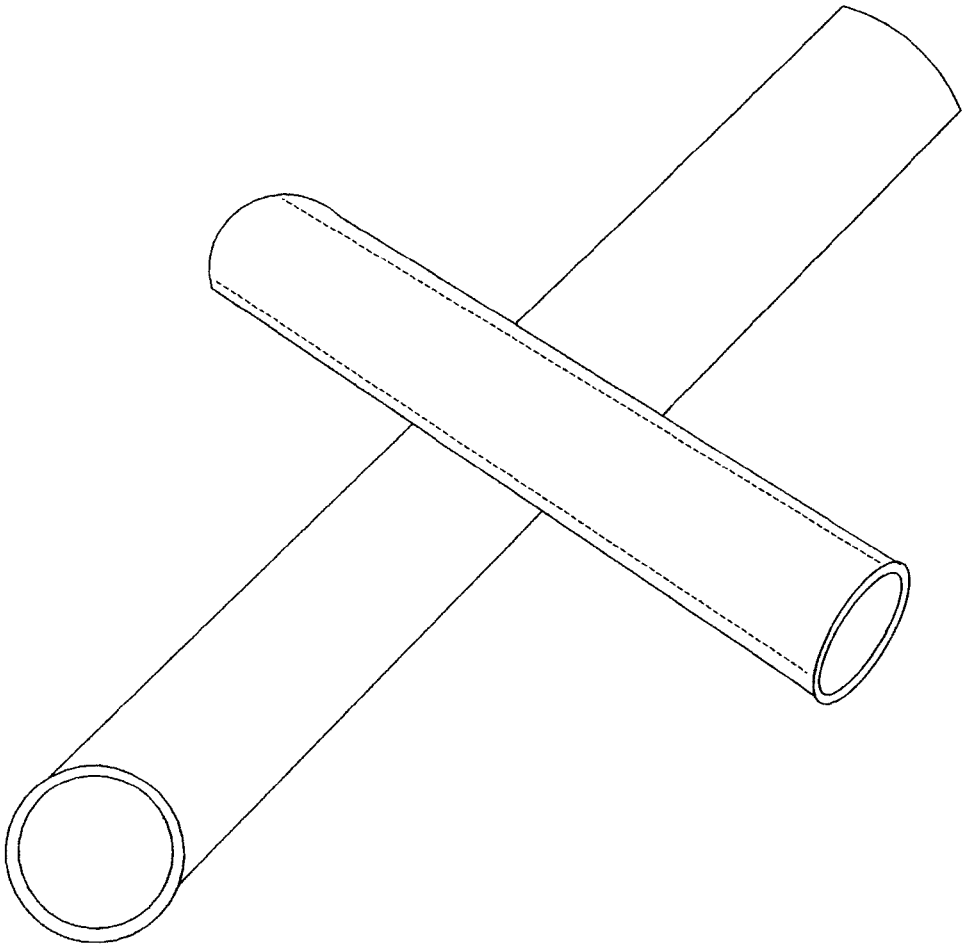
FIG. 2 is a schematic view of adapter 10.

The Kapinos Adapter has a utilitarian purpose and offers an a improved method of carpet installation. There are no existing accessories or attachments that allow an area of carpet to be simultaneously powerstretched. With the introduction of the Kapinos Adapter, powerstretching will take less time by allowing a new method of stretching to take place.

The Kapinos adapter has a cylindrical cross shape. It has a length of 12" and a width of 1". The outside diameter of the cylindrical shape is 2.75". The inside diameter of the Kapinos Adapter is 2.50", which accomodates powerstretcher tubes. The Kapinos adapter has an impassable width section that is used for a powerstretcher anchor point on either side of the adapter. The 12" tubular length is meant to be penetrated by the powerstretcher tubes and the Kapinos adapter remains movable by sliding along the tubes.

Ideally, the Kapinos adapter should be a premolded, lightweight and made from a high strength metal. Perhaps, the same aluminum alloy the powerstretcher tubes are made from. That decision should be made by a professional in the field. The Kapinos adapter tested in the field was made from steel. It can be mass produced by a manufacturing company that works with metal casts.

The Kapinos Adapter has been field tested and it works.

What is claimed is:

1. A process for installing carpet, comprising the steps of disposing an adapter on said carpet, disposing a first carpet stretching device comprised of a first pipe and a second pipe within said adapter, disposing a second carpet stretching device comprised of a third pipe and a fourth pipe within said adapter, stretching a first portion of said carpet in a first direction with said first carpet stretching device, and simultaneously stretching a second portion of said carpet in a second direction with said second carpet stretching device, wherein said first direction and said second direction are substantially perpendicular to each other, wherein:

(a) said adapter is comprised of a first tube, a second tube, a third tube, and a fourth tube, wherein:

1. each of said tubes is integrally connected to each other to form a unitary, cross-shaped structure,
2. said first tube is substantially perpendicular to said second tube, said second tube is substantially perpendicular to said third tube, and said third tube is substantially perpendicular to said fourth tube,
3. said first tube and said third tube are aligned with each other, and said second tube and said fourth tube are aligned with each other, (b) said first carpet stretching device is comprised of said first pipe and said second pipe, wherein said first pipe is disposed within said first tube, and said second pipe is disposed within said third tube, and (c) said second carpet stretching device is comprised of a third pipe and a fourth pipe, wherein said third pipe is disposed within said second tube, and said fourth is disposed within said fourth tube.

* * * * *